US009051674B2

(12) United States Patent
Park et al.

(10) Patent No.: US 9,051,674 B2
(45) Date of Patent: Jun. 9, 2015

(54) LAUNDERING MACHINE AND METHOD

(75) Inventors: Eun Jin Park, Changwon-si (KR); Deug Hee Lee, Changwon-si (KR); Pyoung Hwan Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 302 days.

(21) Appl. No.: 13/254,742

(22) PCT Filed: Jul. 1, 2010

(86) PCT No.: PCT/KR2010/004289
§ 371 (c)(1),
(2), (4) Date: Sep. 2, 2011

(87) PCT Pub. No.: WO2011/002248
PCT Pub. Date: Jan. 6, 2011

(65) Prior Publication Data

US 2011/0308023 A1 Dec. 22, 2011

(30) Foreign Application Priority Data

Jul. 3, 2009 (KR) ..... 10-2009-0060592
Aug. 11, 2009 (KR) ..... 10-2009-0073776

(51) Int. Cl.
*A47L 15/00* (2006.01)
*D06F 35/00* (2006.01)
*D06F 33/02* (2006.01)

(52) U.S. Cl.
CPC ..... *D06F 35/005* (2013.01); *A47L 15/0047* (2013.01); *A47L 2401/20* (2013.01); *A47L 2501/34* (2013.01); *D06F 33/02* (2013.01)

(58) Field of Classification Search
None
See application file for complete search history.

(56) References Cited

U.S. PATENT DOCUMENTS

| | | | | |
|---|---|---|---|---|
| 2,983,129 | A | 5/1961 | Metzger | |
| 2004/0089029 | A1 * | 5/2004 | Sakita et al. | 68/12.12 |
| 2005/0050647 | A1 * | 3/2005 | Tanaka et al. | 8/158 |

FOREIGN PATENT DOCUMENTS

| | | | |
|---|---|---|---|
| CN | 86207065 | U | 12/1987 |
| CN | 1536127 | A | 10/2004 |
| CN | 1990940 | A | 7/2007 |
| EP | 0226209 | A2 | 6/1987 |
| EP | 1887443 | A1 | 2/2008 |
| WO | WO 2008/091124 | A2 | 7/2008 |

* cited by examiner

*Primary Examiner* — Jason Ko
(74) *Attorney, Agent, or Firm* — Birch, Stewart, Kolasch & Birch, LLP

(57) ABSTRACT

The present invention relates to laundering machine and method. The laundering machine includes a tub for holding washing water, a drum rotatably mounted in the tub, a driving unit for rotating the drum, and a control unit for carrying out a washing process such that a washing course (S240) is started at a starting time of scheduled operation and a standby time period is provided before a spinning course (S260). The laundering method includes a washing step for performing a washing course (S240), a rinsing step for performing a rinsing course (S250), a spinning standby step for standing by a predetermined time period at user's option after the rinsing step, and a spinning step for progressing spinning after the spinning standby step.

13 Claims, 12 Drawing Sheets

LAUNDERING MACHINE AND METHOD

TECHNICAL FIELD

The present invention relates to laundering machines, and more particularly, to a laundering machine which can make a scheduled operation available in midnight time period, and enables to progress a particular course after delay of the course in the midnight scheduled operation and a method thereof.

BACKGROUND ART

In general, the laundering machine removes various kinds of contaminants from clothes and beddings by using a softening action of detergent, friction of water flow and impacts applied to laundry caused by rotation of a pulsator or a drum. Current full automatic laundering machine carries out a series of courses of washing, rinsing, spinning, and so on automatically without any intervention of a user.

It is a current trend that demands for the drum type laundering machine increase gradually, which, not only enables to reduce a total height, but also does not cause problems of entangling and crumpling of the laundry in comparison to a pulsator type laundering machine in which a washing tub rotates in an upright position.

A structure of the laundering machine will be described briefly. The laundering machine is provided with a body cabinet which forms an exterior of the laundering machine, a tub in the body cabinet supported by dampers and springs for holding washing water, and a cylindrical drum in the tub for placing the laundry therein, wherein the drum has driving power applied thereto by a driving unit, for washing the laundry placed therein.

The laundering machine is provided with a scheduling function for operating the laundering machine at a preset time by a user's selection. That is, once the user sets an operation time, the laundering machine performs washing operation according to scheduled settings as the preset operation time comes.

In the meantime, recently, a system is put into practice, in which cheap electricity is used at a midnight period or a selected time period when use of electric power is small, avoiding a time period when the use of electric power increases sharply (for an example, midnight electricity, saving electricity, and so on, and hereafter called as saving electricity).

In a case of the scheduling function of the related art laundering machine, a schedule is set to start washing (or drying) operation after a time period from a time point when the operation is set.

Therefore, the user is required to set a schedule such that an operation starting time is set by subtracting the present time when the user makes the operation schedule from the operation starting time, which requires the user's personal calculation that is inconvenient and cumbersome to the user.

Moreover, in order to make the scheduled operation in the saving electricity time period, there is inconvenience of calculating the scheduled operation time, taking both the scheduled operation time and the saving electricity time period into account.

Moreover, since a time period of the saving electricity varies with countries, regions, and so on, the user is required to know each of the saving electricity time periods, and has inconvenience of producing and setting the scheduled operation time.

Moreover, the saving electricity time period is mostly a midnight time period after twelve o'clock. Therefore, if the laundering machine is used in the saving electricity time period, operation noise from the laundering machine gives inconvenience to the user as well as neighbors.

Furthermore, in a case the scheduled operation is set to be made in the saving electricity time period, the scheduled operation is finished in the midnight time period, leaving spun or dried laundry in the laundering machine for a long time period to cause crumpling at the laundry.

DISCLOSURE OF INVENTION

Technical Problem

To solve the problems, an object of the present invention is to provide a laundering machine which enables setting and operation of a scheduled operation in a mid-nighttime period according to actual time and a method thereof.

Another object of the present invention is to provide a laundering machine which can delay a particular course, or make a particular course finished at a particular time in a case a scheduled operation is performed in the midnight time period and a method thereof.

Solution to Problem

To achieve these objects and other advantages and in accordance with the purpose of the invention, as embodied and broadly described herein, a laundering machine includes a tub for holding washing water, a drum rotatably mounted in the tub, a driving unit for rotating the drum, and a control unit for carrying out a washing process such that a washing course is started at a starting time of scheduled operation and a standby time period is provided before a spinning course.

Preferably, the control unit has an actual timer for producing an actual time.

Preferably, the control unit performs a washing course and a rinsing course of a washing process as the starting time of the scheduled operation comes, and finishing a spinning course at a finishing time of the scheduled operation set by the user after standing by a predetermined time period.

Preferably, the control unit performs a washing course and a rinsing course of a washing process as the starting time of the scheduled operation comes, and starting a spinning course according to user's operation after standing by a predetermined time period.

In another aspect of the present invention, a laundering method includes a washing step for performing a washing course, a rinsing step for performing a rinsing course, a spinning standby step for standing by a predetermined time period at user's option after the rinsing step, and a spinning step for progressing spinning after the spinning standby step.

Preferably, the washing step starts at a starting time of a scheduled operation set by the user.

Preferably, the spinning step is finished at a finishing time of the scheduled operation set by the user.

Preferably, the spinning standby step includes the step of draining rinsing water used in the rinsing step and standing by.

Preferably, the method further includes the step of supplying additional rinsing water and progressing additional rinsing before the spinning step.

Preferably, the spinning step includes the step of draining the rinsing water used in the rinsing step before progressing the spinning.

Preferably, the method further includes the step of supplying additional rinsing water after the rinsing step and standing by until the spinning standby step comes.

Preferably, the spinning step is progressed by user's operation.

Preferably, the spinning standby step further includes an indicating step of indicating to the user that the spinning standby step is under progress.

Preferably, the washing step starts at the starting time of the scheduled operation set by the user and finishes at the finishing time of the scheduled operation set by the user.

Preferably, the starting time of the scheduled operation and the finishing time of the scheduled operation are set by an actual time input.

Preferably, the method further includes a scheduled operation standby step for determining whether the scheduled operation is set by the user or not before the washing step and standing by until the starting time of the scheduled operation comes.

Preferably, the spinning standby step is preformed in a midnight time period set by the user.

Preferably, the midnight time period is a saving electricity supply time period in which saving electricity is supplied.

Preferably, the rinsing step includes the step of omitting a brief spinning process to be progressed between adjacent rinsing processes.

In another aspect of the present invention, a laundering method includes a washing step for starting a washing course at a starting time of scheduled operation set by a user, a rinsing step for performing a rinsing course, a spinning step for performing a spinning course, and a tumbling step for performing tumbling until a finishing time of the scheduled operation set by the user after the spinning step.

Advantageous Effects of Invention

The present invention has following advantageous effects.

Since a midnight time period scheduled operation setting and a midnight time period scheduled operation time setting can be made with reference to the actual time, the present invention permits the user to set the scheduled operation more easily.

The making a particular course to delay or finish at a particular time according to the scheduled operation of the midnight time period permits an efficient washing.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE FOR CARRYING OUT THE INVENTION

Reference will now be made in detail to the specific embodiments of the present invention, examples of which are illustrated in the accompanying drawings. Wherever possible, the same reference numbers will be used throughout the drawings to refer to the same or like parts.

In describing the present invention, names of elements are defined taking functions thereof into account. Therefore, it is required to understand that the names do not limit the elements technically. Moreover, the names of the elements may be called differently in this field of art.

A laundering machine in accordance with a preferred embodiment of the present invention will be described in detail with reference to the attached drawings.

In the meantime, the present invention will be described taking a drum type washing machine as an example. However, the present invention is applicable to other types of laundering machines, too.

Moreover, the laundering machine of the present invention will be described, taking operation in a midnight time period as an example. The midnight time period can be applied the same with a saving electricity supply time period of each region. However, different from the saving electricity time period, a particular time period can be defined and applied as the midnight time period by the user.

Figure 1:
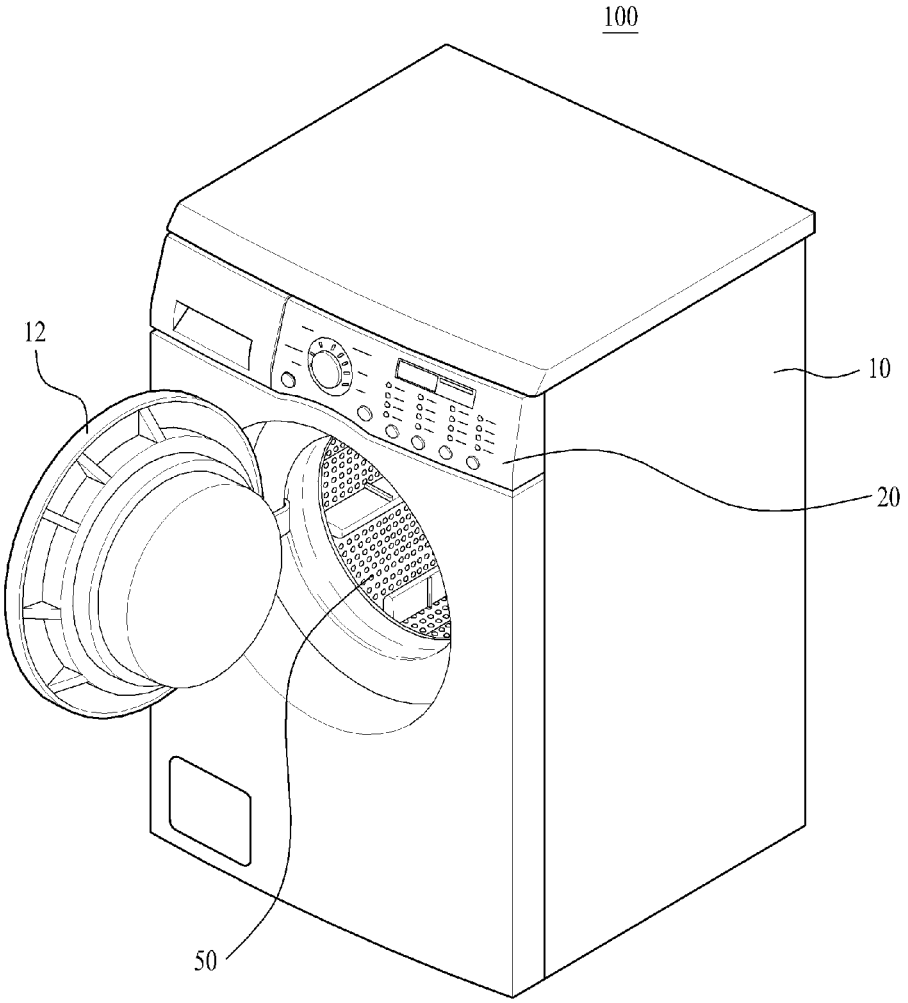
FIG. 1 illustrates a perspective view of a laundering machine in accordance with a preferred embodiment of the present invention.
Figure 2:
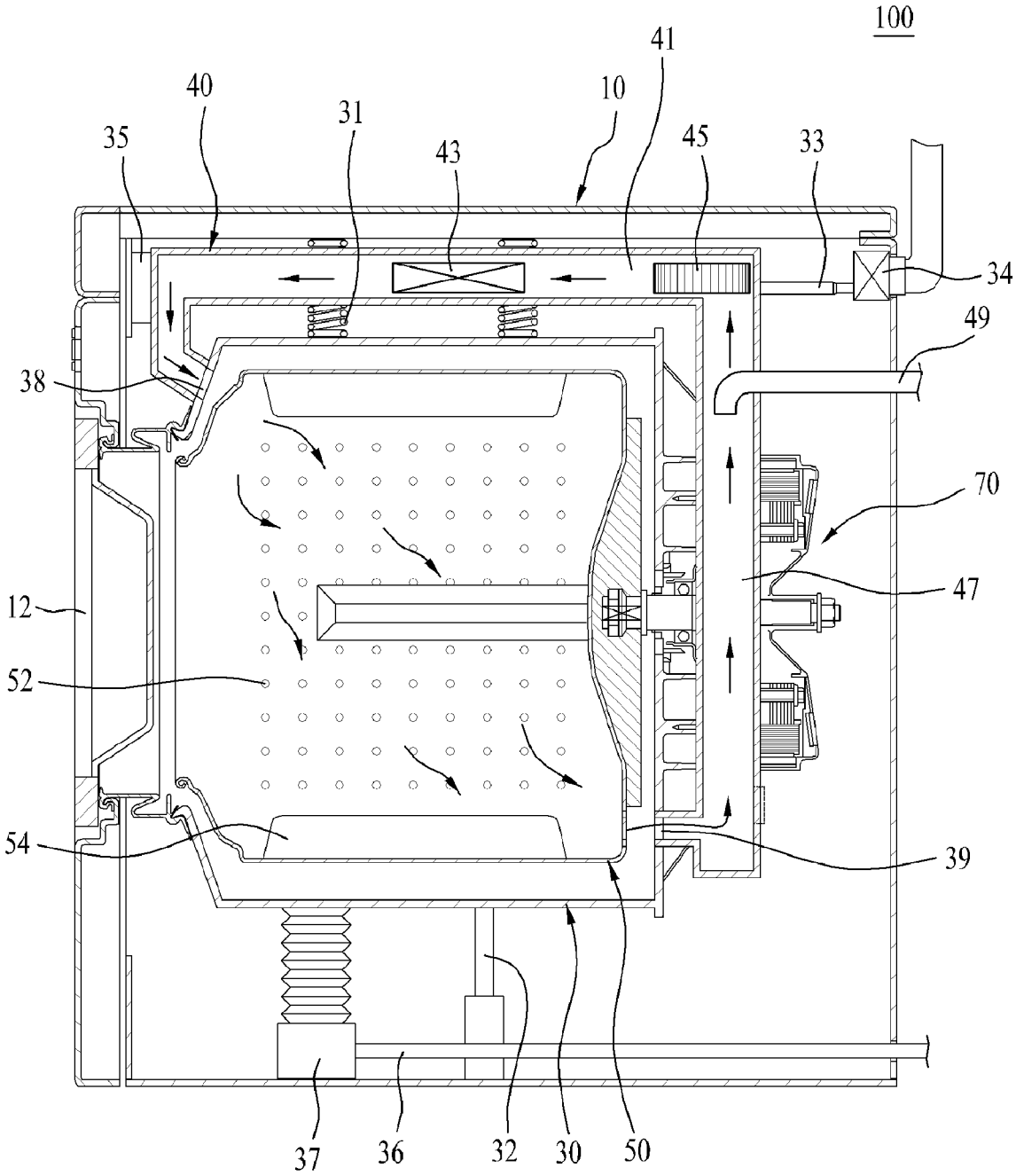
FIG. 2 illustrates a longitudinal section of a laundering machine in accordance with a preferred embodiment of the present invention.
Figure 3:
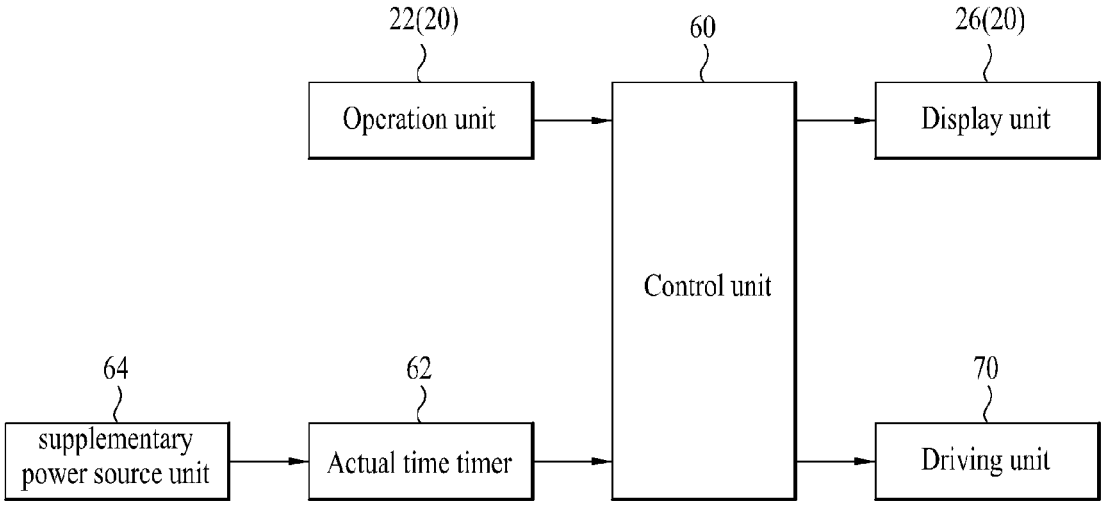
FIG. 3 illustrates a block diagram of a system of a laundering machine in accordance with a preferred embodiment of the present invention.

FIG. 1 illustrates a perspective view of a laundering machine in accordance with a preferred embodiment of the present invention, FIG. 2 illustrates a longitudinal section of a laundering machine in accordance with a preferred embodiment of the present invention, and FIG. 3 illustrates a block diagram of a system of a laundering machine in accordance with a preferred embodiment of the present invention.

Referring to FIGS. 1 and 2, the laundering machine 100 includes a cabinet 10 which forms an exterior of the laundering machine 100, a tub 30 in the cabinet 10 for holding washing water, a drum 50 mounted in the tub 30 to be rotatable in a shaft direction, a driving unit 70 for providing rotating power to the drum 50 to wash, rinse and spin laundry in the drum 50, a control unit 60 (See FIG. 3) for controlling respective units to operate the laundering machine 100, and an operation panel 20 for controlling respective units in association with the control unit 60.

The cabinet 10 forms the exterior of the laundering machine 100, and has respective units to be described later mounted to an outside or inside thereof. The cabinet 10 has a door 12 rotatably mounted to a front of the cabinet 10 for introducing the laundry.

The tub 30 holds the washing water in the cabinet 10, and has a hull shape opened toward the door 12 for holding the laundry introduced through the door 12.

The driving unit 70 is mounted to a rear of the tub 30 for rotating the drum 50. The driving unit 70 having a motor and so on rotates the drum 50. The driving unit 70 has a rotation speed controlled by the control unit 60. Detailed description of the driving unit 70 will be omitted since structures, and kinds of the driving unit 70 are well known to persons skilled in this field of art, and a variety of embodiments are possible.

In the meantime, the tub 30 is elastically supported by springs 31 above the tub 30 and dampers 32 below the tub 30. Accordingly, at the time vibration generated when the drum 50 is rotated by the driving unit 70 transmits to the cabinet 10 through the tub 30, the vibration is buffered and dampened by the springs 31 and the dampers 32, thereby reducing transmission of the vibration caused by rotation of the drum 50 to the cabinet 10 from the drum 50.

Above the tub 30, there are a water supply hose 33 for supplying water to the tub 30 from an external water source, a water supply valve 34 on the water supply hose 33 for controlling in/out of the water, and a detergent supply unit 35 for holding detergent such that the water being supplied through the water supply hose 33 is introduced to the tub 30 together with the detergent.

And, below the tub 30, there are a drain hose 36 and a drain pump 37 for draining the washing water used for washing and rinsing to an outside of the laundering machine 100.

In the meantime, mounted to an outside of the tub 30, there is a circulating duct 40 for circulating air for drying course of the laundering machine 100. That is, the circulating duct 40 is configured to draw air out of the tub 30, heat the air, and return the air to the tub 30, again.

The circulating duct 40 includes a drying duct 41 and a condensing duct 47. The drying duct 41 has a heater 43 and a fan 45 for blowing hot air into the tub 30.

The drying duct 41 and the condensing duct 47 are mounted to be in communication with each other, as well as with the drum 50, and the tub 30 has an air inlet 38 for introduction of hot air thereto through the drying duct 41, and an air outlet 39 for discharging air to the condensing duct 47. The condensing duct 47 has a water supplying unit 49 for supplying cooling water to the condensing duct 47 for condensing moisture in the air.

The drum 50 is rotatably mounted in the tub 30, and has the laundry introduced thereto through the door 12 held therein. The drum 50 has a plurality of drain holes 52 for in/out of water therethrough, and a plurality of lifts 54 for lifting and dropping the laundry in the drum 50 when the drum 50 rotates. By the lifting and dropping of the laundry with the lifts 54, washing performance can be improved.

Figure 4:
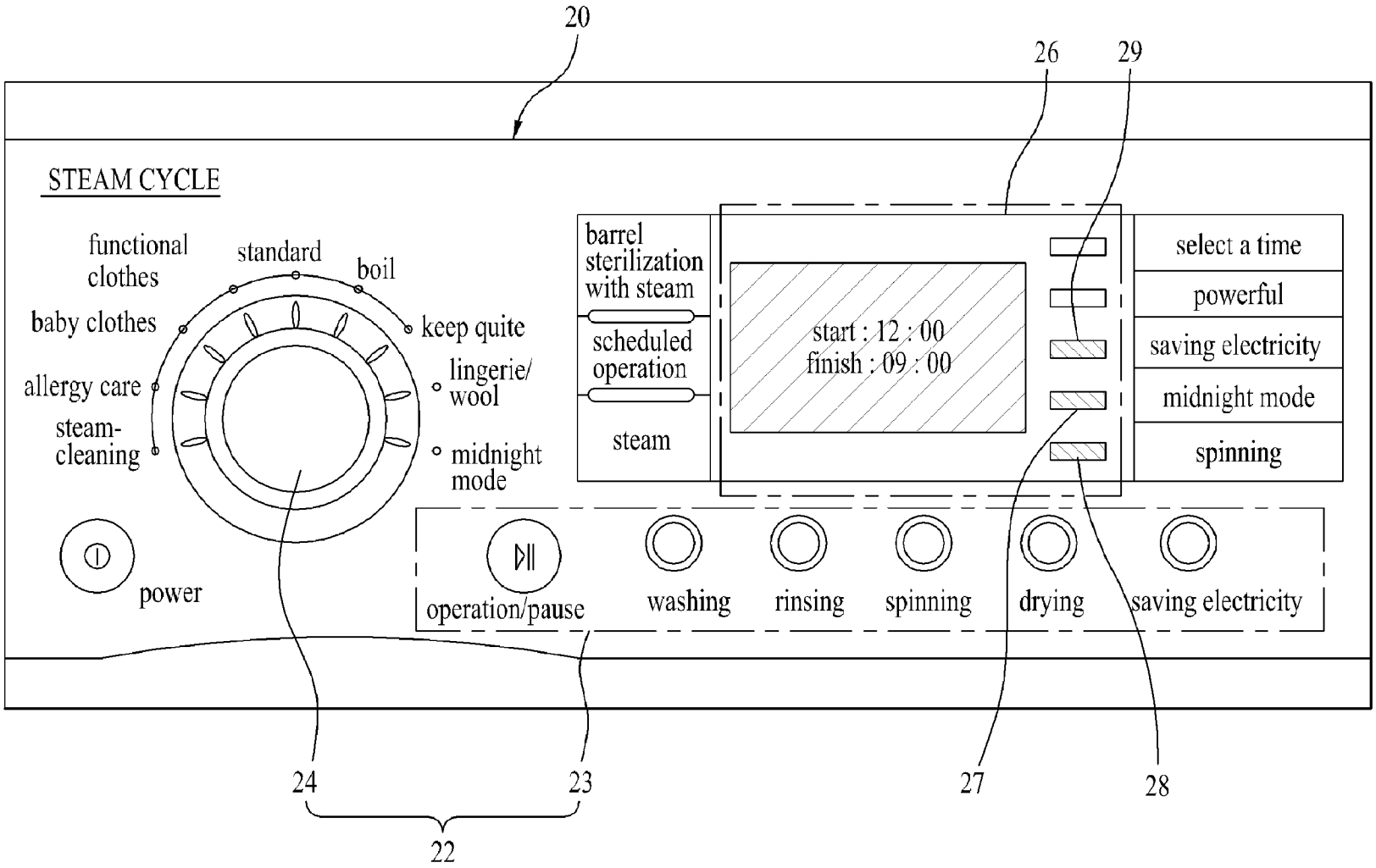
FIG. 4 illustrates a plan view of an operation panel of a laundering machine in accordance with a preferred embodiment of the present invention, schematically.

The operation panel 20 on an upper side of the door 12 includes an operation unit 22 for controlling operation of the laundering machine 100 and a display unit 26 for displaying an operation state of the laundering machine 100 (See FIG. 4). The operation panel 20 will be described in detail later with reference to the drawings.

The control unit 60 is shown in FIG. 3. The control unit 60 controls general operation of the laundering machine 100. The control unit 60 operates the laundering machine 100 according to setting at the laundering machine 100. That is, the control unit 60 carries out general operation control, a scheduled operation in a particular time period, a scheduled operation in a midnight time period set by the user, and a delayed operation of a particular course according to the scheduled operation in the midnight time period.

The control unit 60 also includes an actual time timer 62 for producing an actual time according to user's setting. The actual time timer 62 produces, not the present operation time of the laundering machine 100, but times of each course of the laundering machine 100 as well as the present time.

In the meantime, the actual time timer 62 can be operated by power from the power source (not shown) of the laundering machine 100, or by an additional supplementary power source 64 (for an example, a disposable dry battery or rechargeable battery) built therein. If the actual time timer 62 has the supplementary power source 64 built therein, it is advantageous in that the actual time timer 62 is operable even if power supply from the power source which is a main power source of the laundering machine 100 is cut off.

The control unit 60 carries out the scheduled operation according to starting and finishing times of the scheduled operation when the user sets the scheduled operation. And, if saving electricity scheduled operation is set, the control unit 60 can put the laundering machine into operation after waiting until the saving electricity supply time period comes.

And, if midnight scheduled operation is set, the control unit 60 can omit a course which generates much noise at the time of the scheduled operation in the midnight time period. That is, after a washing course and a rinsing course are performed, a spinning course which generates much noise is not progressed directly, but stops to wait for user's operational input or perform the spinning course according to the scheduled operation, later.

In the meantime, if the midnight scheduled operation is set and performed, the control unit 60 displays on the display unit 26 that the spinning course is standby or omitted. According to this, the user can notice that an additional rinsing course or a spinning course is required.

And, as a starting time (for an example, the midnight time period) of the scheduled operation comes, of the washing steps, the control unit 60 can perform the washing course and the rinsing course at first and perform the spinning course and/or the drying course later such that the spinning course and/or the drying course can be finished at a finishing time of the scheduled operation set by the user. That is, as the starting time of the scheduled operation comes, the control unit 60 performs the washing course and the rinsing course, and is standby a certain time period before finishing time of the scheduled operation inclusive of the spinning or drying course.

In the meantime, in above description, as the scheduled operation starting time comes, the control unit 60 performs the washing course and the rinsing course at first. However, in a case of laundry which does not matter crumpling of the laundry, the user may control setting of the control unit such that the washing course, rinsing course and the spinning course are preformed at first, and only the drying course is performed, later.

The operation panel 20 is shown in FIG. 4. The operation unit 22 and the display unit 26 control operation of the laundering machine 100 in association with the control unit 60 or display an operation state of the laundering machine 100.

The operation unit 22 has a plurality of buttons 23 and a rotary knob 24. The buttons 23 and the rotary knob 24 which is inputting means for operating the laundering machine 100, enables the user to input desired course and time by handling the buttons 23 and the rotary knob 24 when the user selects a setting of a washing course (for an example, a standard course, a boiling course, a functional clothes course, and so on), setting of a washing detail (for an example, a washing course, a rinsing course, a spinning course, a drying course, a midnight mode, saving electricity, and so on) and setting of scheduled operation (for an example, a washing starting time, a washing finishing time, saving electricity, and so on).

The display unit 26 which displays information on the laundering machine 100 set at the operation unit 22 includes a plurality of LEDs and LCD arranged side by side for displaying different pieces of washing information for the user, such as a state of progress of washing, a remained time period, and so on with characters or codes by flashing or the LEDs, or on the LCD.

The display unit 26 has a midnight mode indicating unit 27 for displaying that the midnight scheduled operation is set, a saving electricity indicating unit 29 for displaying that the scheduled operation in the saving electricity time period is set, and a spinning progress indicating unit 28 for displaying the spinning course is omitted after the scheduled operation.

Moreover, the display unit 26 displays the scheduled operation starting time and the scheduled operation finishing time the user inputs for the user to set the scheduled operation starting time and the scheduled operation finishing time at the time the user sets the scheduled operation.

Accordingly, the operation of the laundering machine in accordance with a preferred embodiment of the present invention will be described. It is required that respective units described below are understood with reference to the foregoing description and drawings.

The laundering machine of the present invention is related to the scheduled operation by using an actual time and midnight time period. Therefore, detailed description of operation of the laundering machine related to general washing course, rinsing course, spinning course, drying course will be omitted for making subject matters of the present invention distinctive.

In the meantime, the laundering machine of the present invention is related to a scheduled operation in a midnight time period. Therefore, at the time of an initial operation of the laundering machine 100, steps for setting an actual time and midnight time period are required. In this instance, the midnight time period may or may not be the same with a saving electricity time period in which cheap electricity is used. For conveniences sake, the present invention describes that the midnight time period is the same with the saving electricity time period. However, it does not determine that the midnight time period is the same with the saving electricity time period, but the midnight time period may be set in a time period different from the saving electricity time period.

A method for setting the actual time and the saving electricity time period at the initial operation of the laundering machine 100 of the present invention will be described.

Figure 5:
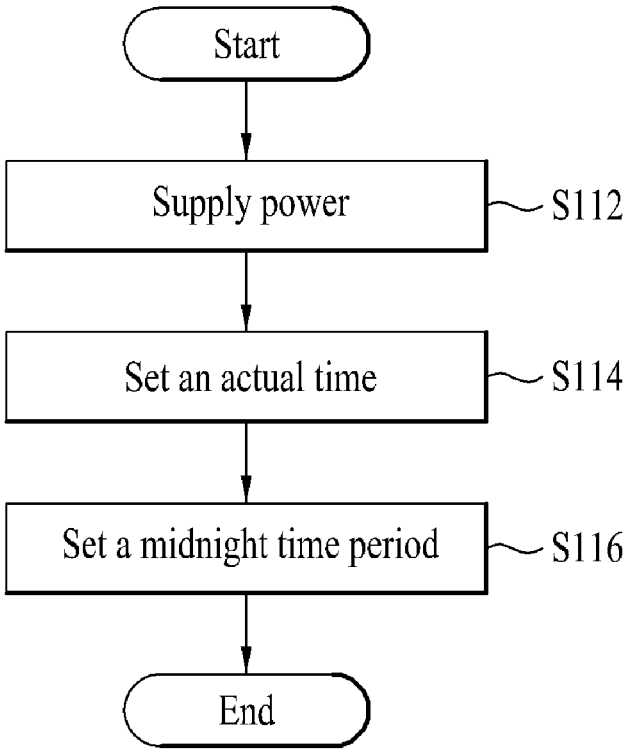
FIG. 5 illustrates a flow chart showing the steps of a method for setting an actual time and a midnight time period to a laundering machine in accordance with a preferred embodiment of the present invention.

FIG. 5 illustrates a flow chart showing the steps of a method for setting an actual time and a midnight time period to a laundering machine in accordance with a preferred embodiment of the present invention.

Referring to FIG. 5, respective units of the laundering machine 100 are come into operation (S112) as the user supplies power through a main power source (not shown) of the laundering machine 100. In this instance, the control unit 60 enables the user to set an actual time of the laundering machine 100 at the display unit 26 of the operation panel 20 (S114). With reference to the actual time inputted at this time, a time of operation, such as a general scheduled operation, a scheduled operation in the midnight time period, and so on can be set by the user.

Then, the control unit 60 displays the midnight time period on the display unit 26 of the operation panel 20. Identical to the actual time, the midnight time period can be set by handling the button 23 on the operation panel 20 (S116). The input of the midnight time period can be set by inputting a starting time and a finishing time of the midnight time period.

In the meantime, though it is described that the actual time setting and the midnight time period setting are made at the time of an initial operation of the laundering machine 100, the actual time setting and the midnight time period setting can be made even after the initial operation of the laundering machine 100 at user's option.

A method for setting a scheduled operation of a laundering machine in accordance with a preferred embodiment of the present invention will be described with reference to the attached drawing.

Figure 6:
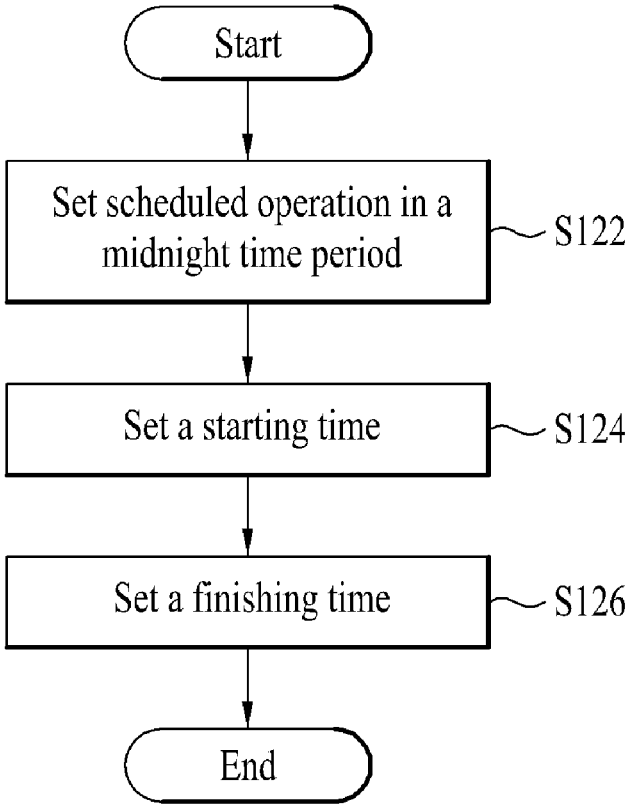
FIG. 6 illustrates a flow chart showing the steps of a method for inputting a time for setting a scheduled operation of a laundering machine in accordance with a preferred embodiment of the present invention.

FIG. 6 illustrates a flow chart showing the steps of a method for inputting a time for setting a scheduled operation of a laundering machine in accordance with a preferred embodiment of the present invention.

At first, the user selects the scheduled operation (S122). The scheduled operation can be selected from the general scheduled operation, and the midnight scheduled operation. In this instance, the user can notice a scheduled state of the scheduled operation set by the user at a midnight mode indicating unit 27 or a saving electricity indicating unit 29 provided to the display unit 26.

A case the scheduled operation set by the user is the midnight scheduled operation will be described.

In a case the scheduled operation set by the user is the midnight scheduled operation, the control unit 60 indicates such that the user can input a starting time of the scheduled operation on the display unit 26 of the operation panel 20 (S124).

Then, if the user's setting of the starting time of the scheduled operation is finished, the control unit 60 indicates such that the user can input a finishing time of the scheduled operation on the display unit 26 of the operation panel 20 (S126).

In this instance, the starting time and finishing time of the scheduled operation is inputted through the actual time, and the control unit 60 is standby until the starting time the user inputs, and performs the scheduled operation as the starting time comes.

In the meantime, the finishing time of the scheduled operation may not be set at user's option, when the control unit 60 carries out the scheduled operation with reference to the starting time of the scheduled operation set by the user.

And, if the scheduled operations et by the user is the general scheduled operation, the control unit 60 indicates on the display unit 20 such that the user input either the starting time of the scheduled operation or the finishing time of the scheduled operation. That is, setting of the general scheduled operation is finished as either the starting time of the scheduled operation or the finishing time of the scheduled operation is input.

A scheduled operation of a laundering machine in accordance with a preferred embodiment of the present invention will be described with reference to the attached drawing.

Figure 7:
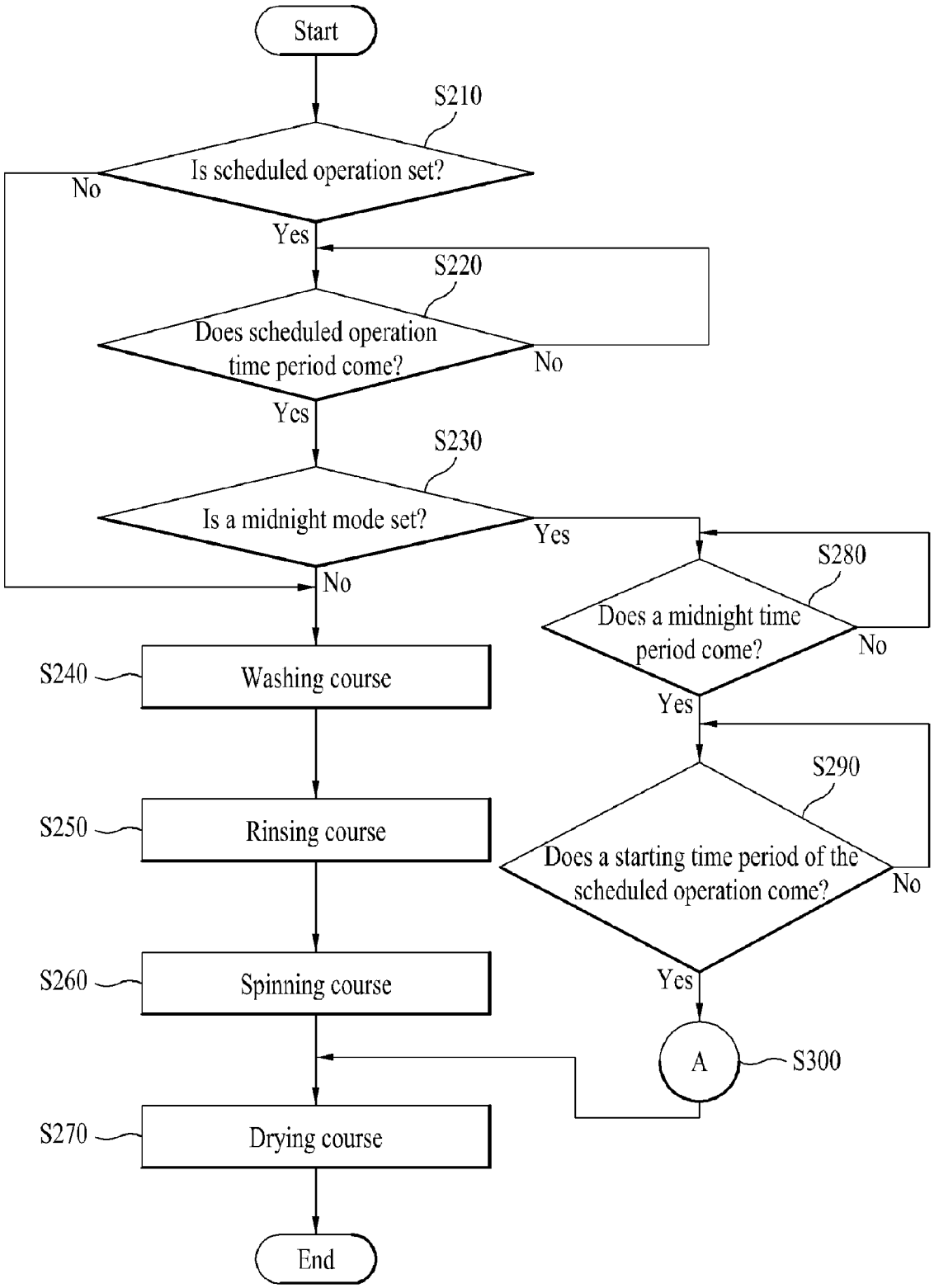
FIG. 7 illustrates a flow chart showing the steps of a method for making a scheduled operation of a laundering machine in accordance with a preferred embodiment of the present invention.

FIG. 7 illustrates a flow chart showing the steps of a method for making a scheduled operation of a laundering machine in accordance with a preferred embodiment of the present invention.

Steps described below are performed in a state the user sets the midnight scheduled operation and the starting time of the scheduled operation and the finishing time of the scheduled operation.

At first, as the user finishes setting of the scheduled operation, the control unit 60 determines whether the scheduled operation is set or not (S210). In this instance, if no scheduled operation is set, the control unit 60 puts the laundering machine 100 into operation according to the washing operation set by the user directly, to progress a washing course (S240), a rinsing course (S250) and a spinning course (S260) in succession. In addition to this, the control unit 60 may perform a drying course (S270), and so on.

In the meantime, if the scheduled operation is set, the control unit 60 determines whether a time of the scheduled operation set thus comes or not, and is standby until the time the scheduled operation comes (S220). If the time of the scheduled operation comes, the control unit 60 determines whether the scheduled operation set thus is the midnight mode (the midnight scheduled operation) or not (S230).

If the scheduled operation set thus is not the midnight mode (i.e., a scheduled operation not related to the midnight time period), the control unit 60 puts the laundering machine 100 into operation according to washing operation set by the user, to progress the washing course (S240), the rinsing course (S225) and the spinning course (S260) in succession. In addition to this, the control unit 60 may perform the drying course (S270), and so on.

In the meantime, if the washing operation set by the user is the midnight mode, the control unit 60 determines whether the midnight time period set by the user comes or not (S280). In this instance, if the midnight time period does not come yet, the control unit 60 is standby until the midnight time period comes.

And, as the midnight time period comes, the control unit 60 determines whether the starting time of the scheduled operation set by the user comes or not (S290). In this instance, the control unit 60 is standby until the starting time of the scheduled operation comes, if the starting time of the scheduled operation does not come.

Thereafter, as the starting time of the scheduled operation comes, the control unit 60 performs washing courses of the midnight mode set already (S300). In this instance, the spinning course in the midnight mode washing process is different from the spinning course in the general washing process. The midnight mode washing process will be described in detail with reference to the attached drawings.

In the meantime, upon finishing the midnight mode washing process, finishing washing process, such as drying course and the like, is performed to complete the washing process (S270). In this instance, following change of progress of the spinning course in the midnight mode washing process, a finishing time of the drying course S270 to be progressed after the spinning course may also be changed.

As described, when the washing process set by the user is the midnight mode, the washing process will be described with reference to the attached drawings.

In the meantime, a washing method of the present invention described hereinafter has a supplementary course added before or after the spinning course in the midnight scheduled operation. Therefore, detailed description of the courses of the washing course and the rinsing course will be omitted.

Figure 10:
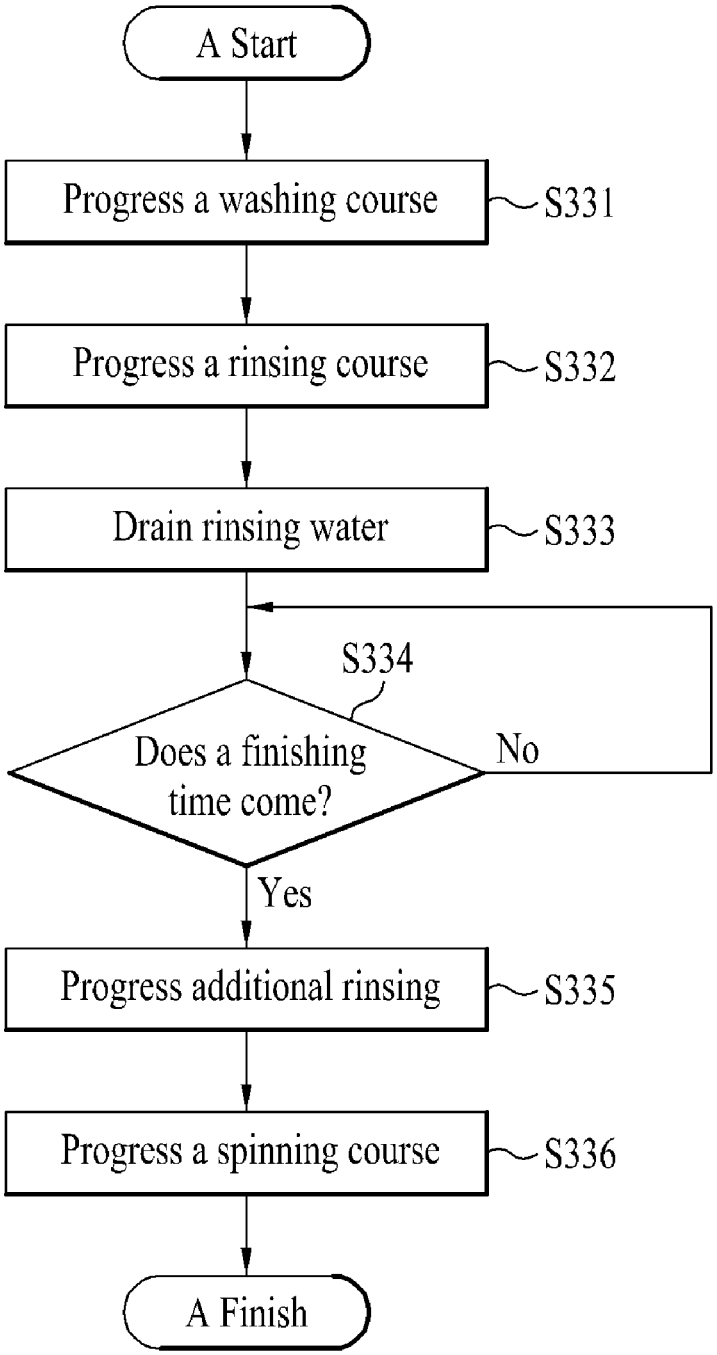
Figure 11:
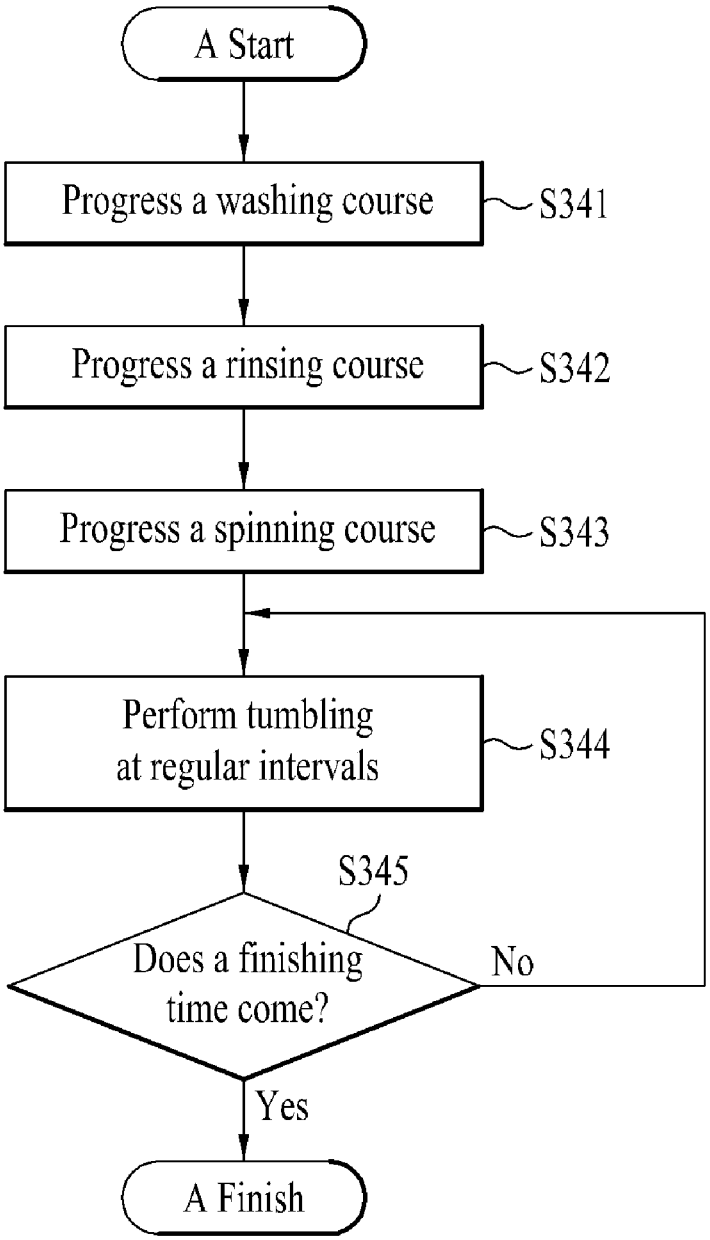
Figure 12:
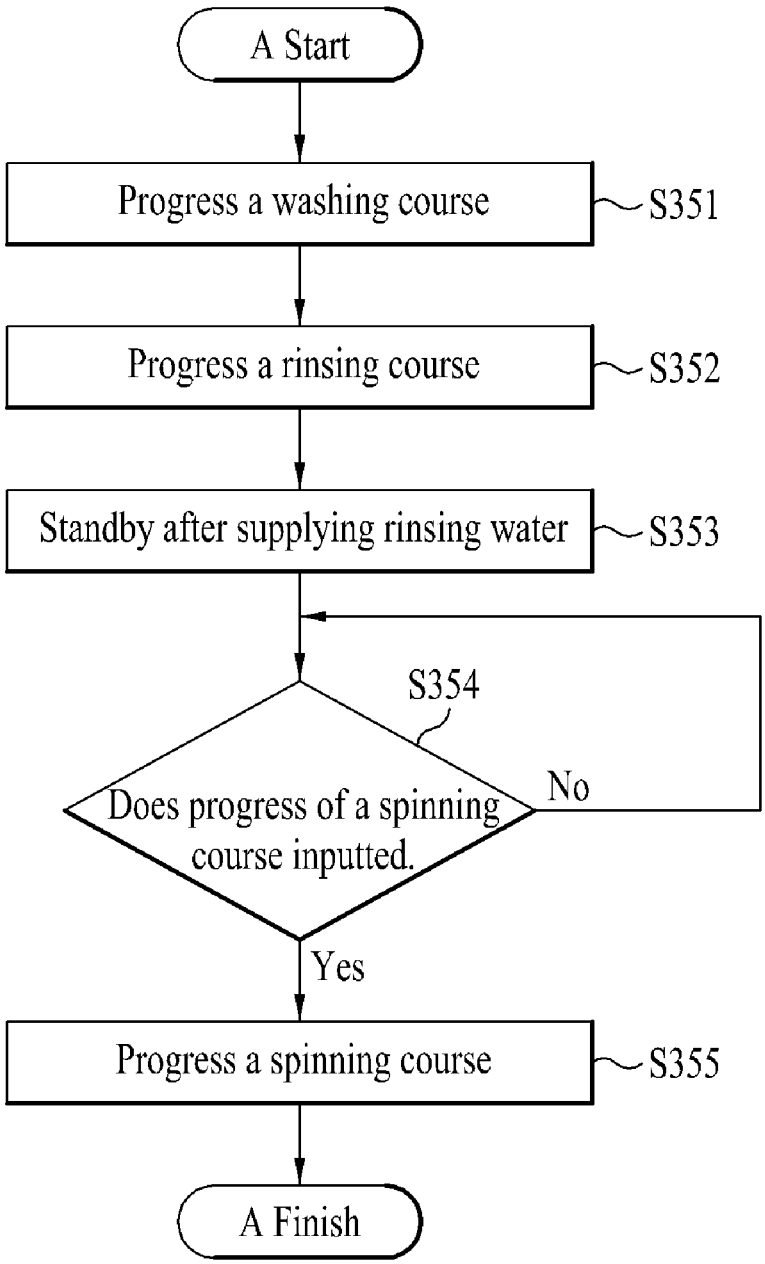
Figure 13:
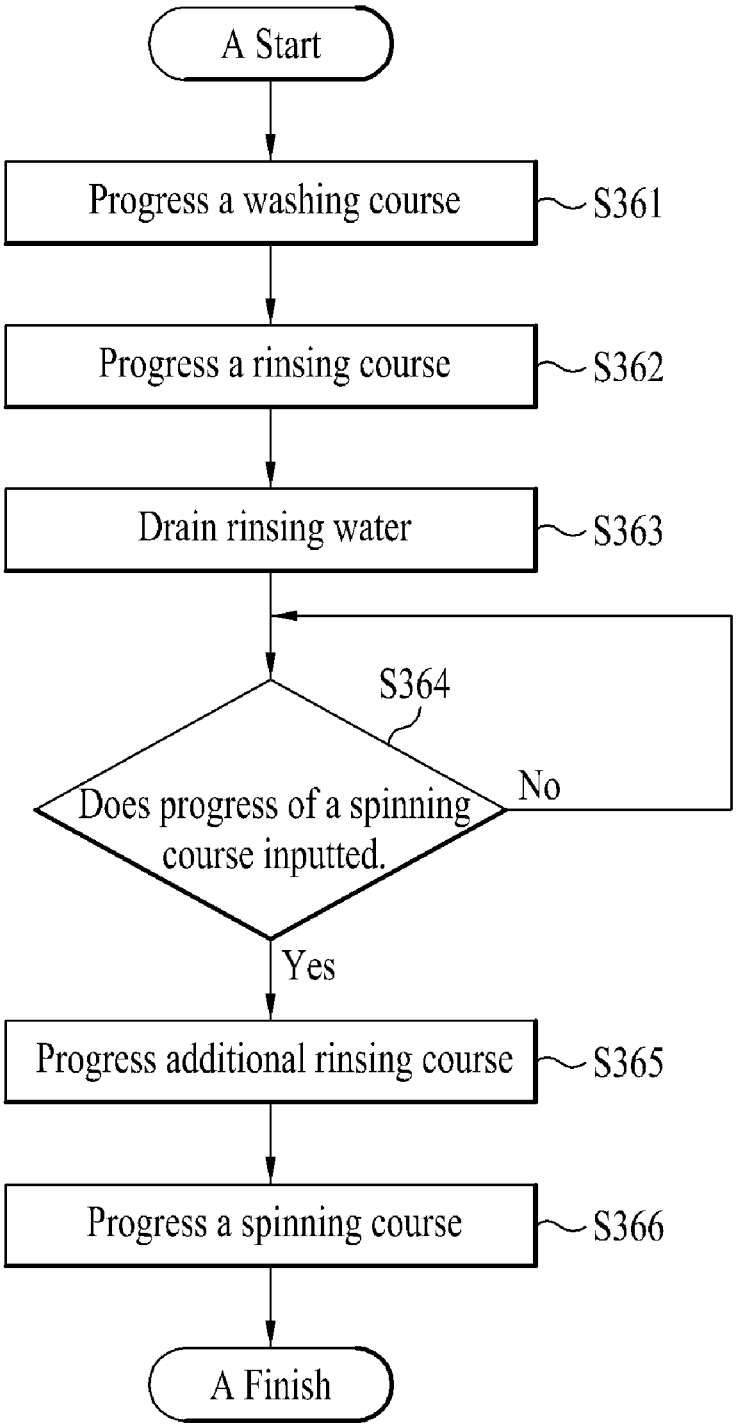

FIGS. 8~13 illustrate flow charts each showing the steps of a method for making a midnight mode washing of a laundering machine in accordance with a preferred embodiment of the present invention, wherein FIGS. 8~11 illustrate flow charts each showing the steps of a method for making a midnight mode washing in a state the starting time and the finishing time of the scheduled operation are set by the user, and FIGS. 12 and 13 illustrate flow charts each showing the steps of a method for making a midnight mode washing in a state only the starting time of the scheduled operation is set by the user.

Figure 8:
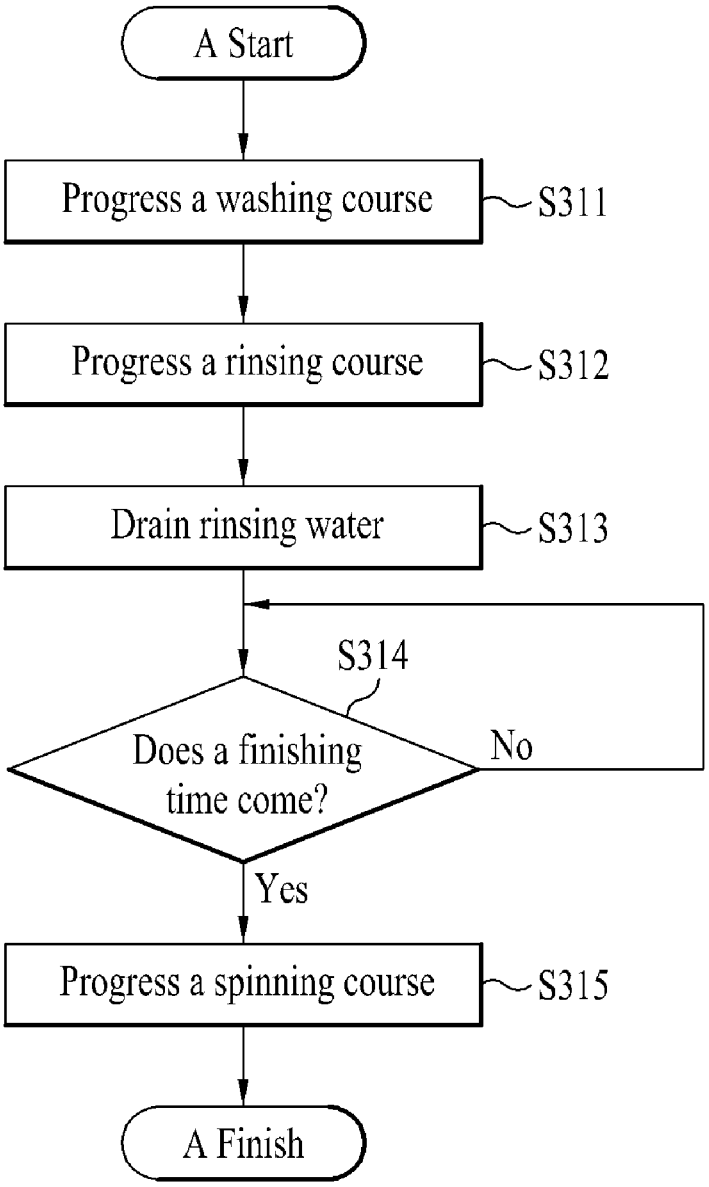
FIGS. 8~13 illustrate flow charts each showing the steps of a method for making a midnight mode washing of a laundering machine in accordance with a preferred embodiment of the present invention.

A midnight mode washing process in accordance with a first preferred embodiment of the present invention will be described with reference to FIGS. 7 and 8.

At first, as described before, the control unit 60 determines whether the starting time of the midnight mode scheduled operation comes or not (S290, See FIG. 7). According to this, the control unit 60 controls respective driving units of the laundering machine 100 to progress the washing course S311 and the rinsing course S312. Then, the control unit 60 drains the washing water used in the rinsing course (S313).

In the meantime, in the rinsing course, rinsing is made repeatedly for improving a rinsing performance. And, brief spinning can be progressed between adjacent rinsing made repeatedly. However, in the present invention, considering that the operation is made in the midnight time period, the brief spinning step may be omitted and a number of rinsing times may be increased for minimizing generation of noise.

Then, the control unit 60 determines whether the finishing time of the scheduled operation set by the user comes or not (S314). The finishing time of the scheduled operation the control unit 60 determines is a finishing time excluding a time period required for the spinning course to be progressed, later. That is, since the time period required for the spinning course can be changed with a laundry amount and a washing water temperature, the control unit 60 calculates the time period required for the spinning course according to the laundry amount and the washing water temperature, and uses a time period excluding the calculated time period in calculation of the finishing time of the scheduled operation.

Accordingly, as the finishing time of the scheduled operation comes, the control unit 60 progresses the spinning course S315 to finish the midnight scheduled washing operation. The drying course S270 (See FIG. 7) may be performed after finishing the spinning course, additionally.

Figure 9:
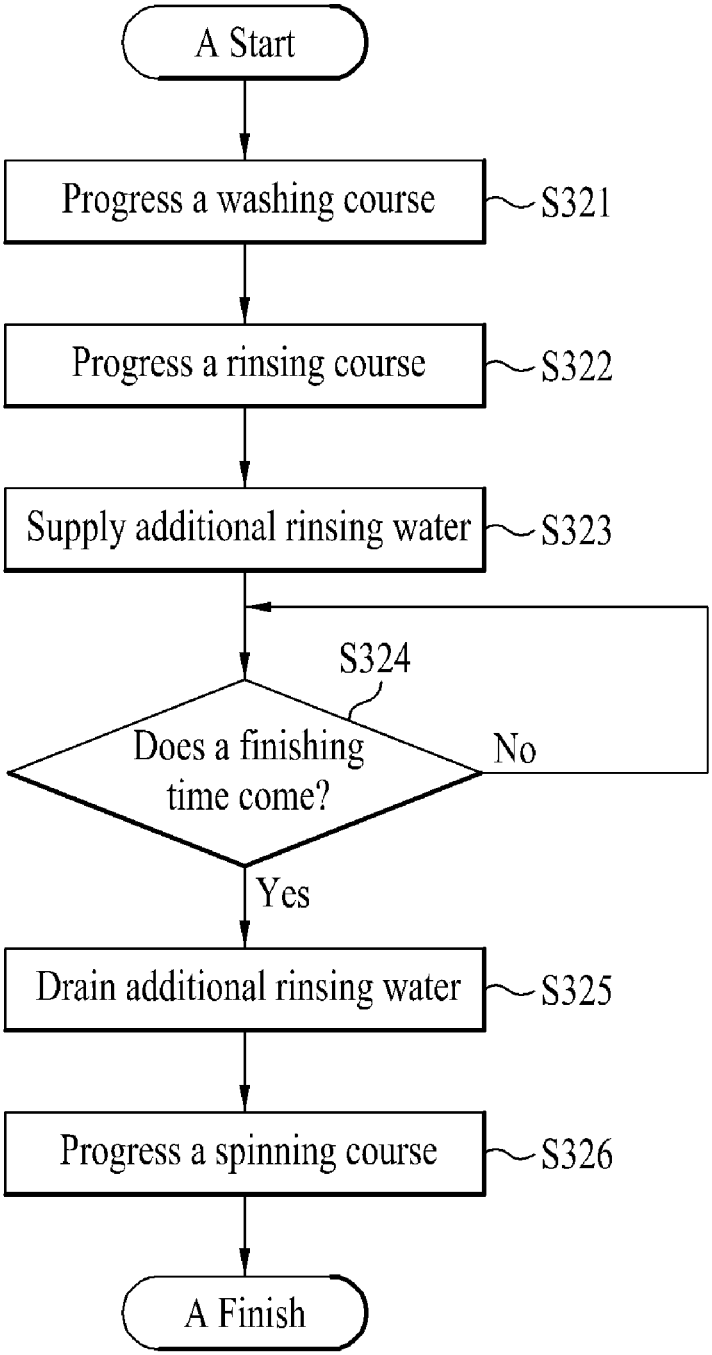

A midnight mode washing process in accordance with a second preferred embodiment of the present invention will be described with reference to FIGS. 7 and 9.

At first, as described before, the control unit 60 determines whether the starting time of the midnight mode scheduled operation comes or not (S290, See FIG. 7). According to this, the control unit 60 controls respective driving units of the laundering machine 100 to progress the washing course S321 and the rinsing course S322. Then, as the rinsing course is finished, the control unit 60 drains the washing water used in the rinsing course.

In the meantime, in the rinsing course, rinsing is made repeatedly for improving a rinsing performance. And, brief spinning can be progressed between adjacent rinsing made repeatedly thus. However, in the present invention, considering that the operation is made in the midnight time period, the brief spinning step may be omitted and a number of rinsing times may be increased for minimizing generation of noise.

Then, if a last rinsing of the rinsing course is finished, the control unit 60 supplies rinsing water additionally for keeping the laundry submerged in the rinsing water and is standby (S323). This is because crumpling of the laundry can be prevented even if the laundry is left for a long time period if a proper amount of rinsing water is supplied to the laundry.

Then, the control unit 60 determines whether the finishing time of the scheduled operation set by the user comes or not (S324). The finishing time of the scheduled operation the control unit 60 determines is a finishing time excluding a time period required for performing the spinning course, later. That is, since the time period required for the spinning course can be changed with a laundry amount and a washing water temperature, the control unit 60 calculates the time period required for the spinning course according to the laundry amount and the washing water temperature, and uses a time period excluding the calculated time period in calculation of the finishing time of the scheduled operation.

Accordingly, as the finishing time of the scheduled operation comes, the control unit 60 progresses the spinning course S326 to finish the midnight scheduled washing operation. The drying course S270 (See FIG. 7) may be performed after finishing the spinning course, additionally.

A midnight mode washing process in accordance with a third preferred embodiment of the present invention will be described with reference to FIGS. 7 and 10.

At first, as described before, the control unit 60 determines whether the starting time of the midnight mode scheduled operation comes or not (S290, See FIG. 7). According to this, the control unit 60 controls respective driving units of the laundering machine 100 to progress the washing course S331 and the rinsing course S332. Then, the control unit 60 drains the washing water used in the rinsing course (S333).

In the meantime, in the rinsing course, rinsing is made repeatedly for improving a rinsing performance. And, brief spinning can be progressed between adjacent rinsing made repeatedly. However, in the present invention, considering that the operation is made in the midnight time period, the brief spinning step may be omitted and a number of rinsing times may be increased for minimizing generation of noise.

Then, the control unit 60 determines whether the finishing time of the scheduled operation set by the user comes or not (S334). The finishing time of the scheduled operation the control unit 60 determines is a finishing time excluding a time period required for an additional rinsing and the spinning course to be progressed, later. That is, since the time period required for the spinning course can be changed with a laundry amount and a washing water temperature, the control unit 60 calculates the time period required for the spinning course according to the laundry amount and the washing water temperature, and uses a time period excluding the calculated time period in calculation of the finishing time of the scheduled operation.

Accordingly, as the finishing time of the scheduled operation comes, the control unit 60 supplies rinsing water additionally and performs rinsing additionally (S335). The additional rinsing is performed for removing crumples from the laundry left in the drum 50 for a long time period. The additional rinsing may be performed repeatedly according to a laundry amount and a washing water temperature.

Then, as the additional rinsing is finished, the control unit 60 progresses the spinning course S336 to finish the midnight scheduled washing operation. The drying course S270 (See FIG. 7) may be performed after finishing the spinning course, additionally.

A midnight mode washing process in accordance with a fourth preferred embodiment of the present invention will be described with reference to FIGS. 7 and 11.

At first, as described before, the control unit 60 determines whether the starting time of the midnight mode scheduled operation comes or not (S290, See FIG. 7). According to this, the control unit 60 controls respective driving units of the laundering machine 100 to progress the washing course S341 and the rinsing course S342. Then, the control unit 60 drains the washing water used in the rinsing course (S343).

In the meantime, in the rinsing course, rinsing is made repeatedly for improving a rinsing performance. And, brief spinning can be progressed between adjacent rinsing made repeatedly. However, in the present invention, considering that the operation is made in the midnight time period, the brief spinning step may be omitted and a number of rinsing times may be increased for minimizing generation of noise.

Then, as the rinsing course is finished, the control unit 60 progresses the spinning course (S343). In performing the spinning course, the control unit 60 increases a rotation speed of the drum 50 for reducing a spinning time period required for the spinning course. That is, in order to reduce a noise generating time period shorter than a general spinning course or a general scheduled operation spinning course, the rotation speed of the drum 50 is increased for making the spinning time period shorter.

Upon finishing the spinning course, the control unit 60 performs tumbling of the laundry for preventing the laundry spun thus from crumpling (S344). The tumbling is a process in which the drum 50 is rotated at fixed intervals and fixed time periods in opposite directions alternately to make the laundry in the drum spun thus to move for minimizing crumpling of the laundry after the spinning course. The rotation time periods and the rotation intervals may vary with a laundry amount.

While performing the tumbling of the laundry, the control unit 60 determines whether the finishing time of the midnight mode set by the user comes or not (S345). If the finishing time of the midnight mode does not come, the control unit 60 performs the tumbling of the laundry, repeatedly.

If the finishing time of the scheduled operation set by the user comes, the control unit 60 stops the tumbling of the laundry to finish the midnight scheduled operation of the washing process. The drying course S270 (See FIG. 7) can be performed after finishing the spinning course, additionally.

A laundering method in accordance with fifth or sixth embodiment of the present invention will be described with reference to the attached drawings. The laundering method in accordance with fifth or sixth embodiment of the present invention is a washing method in which the user does not set the finishing time of the scheduled operation. That is, the washing course and the rinsing course are performed in the midnight time period according to the starting time of the scheduled operation set by the user, and the spinning course is progressed without relation to the starting (finishing) time of the scheduled operation by additional setting made later.

A midnight mode washing process in accordance with a fifth preferred embodiment of the present invention will be described with reference to FIGS. 7 and 12.

At first, as described before, the control unit 60 determines whether the starting time of the midnight mode scheduled operation comes or not (S290, See FIG. 7). According to this, the control unit 60 controls respective driving units of the laundering machine 100 to progress the washing course S351 and the rinsing course S352. Then, as the rinsing course is finished, the washing water used in the rinsing course is drained.

In the meantime, in the rinsing course, rinsing is made repeatedly for improving a rinsing performance. And, brief spinning can be progressed between adjacent rinsing made repeatedly thus. However, in the present invention, considering that the operation is made in the midnight time period, the brief spinning step may be omitted and a number of rinsing times may be increased for minimizing generation of noise.

Then, if a last rinsing of the rinsing course is finished, the control unit 60 supplies rinsing water additionally for keeping the laundry submerged in the rinsing water and is standby (S353). This is because crumpling of the laundry can be prevented even if the laundry is left for a long time period if a proper amount of rinsing water is supplied to the laundry.

In this instance, the control unit 60 indicates that drainage of the washing water and the spinning course are omitted at a spinning progress indicating unit 28 in the display unit 26 of the operation panel 20 for the user to notice. In this case, the spinning progress indicating unit 28 may be made to flash at regular intervals for easy notice of the user.

Addition to this, the control unit 60 cuts off power to the laundering machine 100 after the rinsing water supply step S353 for preventing power from wasting. In this case, the control unit 60 activates the spinning progress indicating unit 28 and indicates that the drainage and the spinning course are not progressed if power is supplied to the laundering machine 100 again by the operation of the user, later.

In the meantime, the control unit 60 determines whether the user inputs an order to progress the spinning course, or not. If there is no user's input of the order to progress the spinning course, the control unit 60 maintains activation of the spinning progress indicating unit (S354).

Opposite to this, if the user inputs the order to progress the spinning course S355 by handling the operation unit 22, the control unit 60 performs the spinning course and finishes the scheduled operation of the midnight mode washing. In addition to this, after finishing the spinning course, a drying course S270 (See FIG. 7) can be made. That is, as the midnight mode scheduled operation is finished, the user may check the spinning progress indicating unit 28, and may handle the operation unit 22 for performing the drainage of the washing water and the spinning course, additionally.

A midnight mode washing process in accordance with a sixth preferred embodiment of the present invention will be described with reference to FIGS. 7 and 13.

At first, as described before, the control unit 60 determines whether the starting time of the midnight mode scheduled operation comes or not (S290, See FIG. 7). According to this, the control unit 60 controls respective driving units of the laundering machine 100 to progress the washing course S361 and the rinsing course S362. Then, the control unit 60 drains the washing water used in the rinsing course and is standby (S363).

In the meantime, in the rinsing course, rinsing is made repeatedly for improving a rinsing performance. And, brief spinning can be progressed between adjacent rinsing made repeatedly thus. However, in the present invention, considering that the operation is made in the midnight time period, the brief spinning step may be omitted and a number of rinsing times may be increased for minimizing generation of noise.

In this instance, the control unit 60 indicates that the spinning course is omitted at a spinning progress indicating unit 28 in the display unit 26 of the operation panel 20 for the user to notice. In this case, the spinning progress indicating unit 28 may be made to flash at regular intervals for easy notice of the user.

In addition to this, the control unit 60 cuts off power to the laundering machine 100 after the rinsing course S353 for preventing power from wasting. In this case, the control unit 60 activates the spinning progress indicating unit 28 and indicates that the drainage and the spinning course are not progressed if power is supplied to the laundering machine 100 again by the operation of the user, later.

In the meantime, the control unit 60 determines whether the user inputs an order to progress the spinning course, or not. If there is no user's input of the order to progress the spinning course, the control unit 60 maintains the activation of the spinning progress indicating unit (S364).

Opposite to this, if the user inputs the order to progress the spinning course by handling the operation unit 22, the control unit 60 supplies additional rinsing water and performs an additional rinsing course S365. The additional rinsing is made for removing crumples from the laundry left for a long time in the drum 50. The additional rinsing may be performed repeatedly according to a laundry amount and a washing water temperature.

As the additional rinsing is finished, the control unit 60 performs a spinning course S366 and finishes the scheduled operation of the midnight mode washing process. In addition to this, after finishing the spinning course, a drying course S270 (See FIG. 7) can be made. That is, as the midnight mode scheduled operation is finished, the user may check the spinning progress indicating unit 28, and may handle the operation unit 22 for performing additional rinsing and spinning courses.

In the meantime, description has been made mostly focused on the scheduled operation in the midnight time period. However, if the user operates the laundering machine 100 in the midnight time period, the scheduled operation process may be omitted. That is, the midnight mode can be applied to a general washing process.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A laundering method comprising:

a scheduling step setting a starting time of a scheduled operation and a finishing time of the scheduled operation by a user;

a washing step starting a washing course at the starting time of the scheduled operation set by the user;

a rinsing step performing a rinsing course;

a draining step draining water used in the rinsing step;

a determining step determining a predetermined time period according to the starting time and finishing time set by the user;

a standby step in which spinning is paused for the predetermined time period after the rinsing step;

an additional water supplying step supplying rinsing water after the standby step;

an additional rinsing step performing an additional rinsing course; and a spinning step progressing spinning at the finishing time of the scheduled operation set by the user.

2. The method as claimed in claim 1, wherein the starting time of the scheduled operation and the finishing time of the scheduled operation are set by an actual time input.

3. The method as claimed in claim 1, further comprising a scheduled operation standby step determining whether the scheduled operation is set by the user or not before the washing step and standing by until the starting time of the scheduled operation comes.

4. The method as claimed in claim 1, wherein the standby step is performed in a midnight time period set by the user.

5. The method as claimed in claim 4, wherein the midnight time period is time period in which electricity is relatively cheap compared to other time periods.

6. A laundering method comprising:

a scheduling step setting a starting time of a scheduled operation and a finishing time of the scheduled operation by a user;

a washing step starting a washing course at the starting time of the scheduled operation set by the user;

a rinsing step performing a rinsing course;

a determining step determining a predetermined time period according to the starting time and finishing time set by the user;

a standby step in which spinning is paused for the predetermined time period at the user's option after the rinsing step;

a draining step draining water used in the rinsing step; and a spinning step progressing spinning at the finishing time of the scheduled operation set by the user after the draining step.

7. The method as claimed in claim 6, wherein the starting time of the scheduled operation and the finishing time of the scheduled operation are set by an actual time input.

8. The method as claimed in claim 6, further comprising a scheduled operation standby step determining whether the scheduled operation is set by the user or not before the washing step and standing by until the starting time of the scheduled operation comes.

9. The method as claimed in claim 6, wherein the standby step is performed in a midnight time period set by the user.

10. A laundering method comprising:

a scheduling step setting a starting time of a scheduled operation and a finishing time of the scheduled operation by a user;

a washing step starting a washing course at the starting time of the scheduled operation set by the user;

a rinsing step performing a rinsing course;

a draining step draining water used in the rinsing step;

an additional water supplying step supplying additional rinsing water;

a determining step determining a predetermined time period according to the starting time and finishing time set by the user;

a standby step in which spinning is paused for the predetermined time period at the user's option after the rinsing step;

an additional draining step draining water used in the standby step; and a spinning step progressing spinning at the finishing time of the scheduled operation set by the user after the additional draining step.

11. The method as claimed in claim 10, wherein the starting time of the scheduled operation and the finishing time of the scheduled operation are set by an actual time input.

12. The method as claimed in claim 10, further comprising a scheduled operation standby step determining whether the scheduled operation is set by the user or not before the washing step and standing by until the starting time of the scheduled operation comes.

13. The method as claimed in claim 10, wherein the standby step is performed in a midnight time period set by the user.

* * * * *